US007198558B2

(12) United States Patent
Levsen

(10) Patent No.: US 7,198,558 B2
(45) Date of Patent: Apr. 3, 2007

(54) KNIFE BLADE DRESSING APPARATUS

(75) Inventor: Clark A. Levsen, Shawnee, KS (US)

(73) Assignee: Hantover, Inc., Kansas City, MO (US)

( * ) Notice: Subject to any disclaimer, the term of this patent is extended or adjusted under 35 U.S.C. 154(b) by 130 days.

(21) Appl. No.: 10/907,075

(22) Filed: Mar. 18, 2005

(65) Prior Publication Data

US 2006/0211345 A1 Sep. 21, 2006

(51) Int. Cl.
*B24B 7/17* (2006.01)

(52) U.S. Cl. ..... 451/263; 451/261; 451/293; 451/548

(58) Field of Classification Search ..... 76/87, 76/89.1, 89.2; 451/45, 261, 262, 263, 321, 451/293, 548
See application file for complete search history.

(56) References Cited

U.S. PATENT DOCUMENTS

| | | | | |
|---|---|---|---|---|
| 989,692 | A | 4/1911 | Brower et al. | |
| 2,646,653 | A * | 7/1953 | Murchison | 451/486 |
| 3,032,938 | A * | 5/1962 | Voll | 451/549 |
| 4,090,418 | A | 5/1978 | Ishida | |
| 4,672,778 | A * | 6/1987 | Rieser | 451/486 |
| 4,685,250 | A | 8/1987 | Smith | |
| 4,807,399 | A | 2/1989 | Friel | |
| 5,390,431 | A * | 2/1995 | Friel | 451/45 |
| 5,390,445 | A | 2/1995 | Giovanazzi et al. | |
| 5,478,272 | A | 12/1995 | Cozzini et al. | |
| 5,655,959 | A | 8/1997 | Juranitch | |
| 6,012,971 | A * | 1/2000 | Friel et al. | 451/45 |
| 6,290,582 | B1 | 9/2001 | Eklund | |
| 6,435,951 | B1 * | 8/2002 | Ishizaka | 451/66 |
| 6,752,702 | B1 * | 6/2004 | Thompson et al. | 451/177 |
| 6,875,093 | B2 * | 4/2005 | Friel et al. | 451/260 |
| 2004/0171337 | A1 | 9/2004 | Eklund | |

FOREIGN PATENT DOCUMENTS

| | | |
|---|---|---|
| CH | 502162 | 3/1971 |
| DE | 582357 | 7/1932 |
| DE | A14341872 | 6/1995 |
| DE | A110044614 | 5/2001 |
| FR | 1171230 | 1/1959 |
| WO | 9911428 | 3/1999 |
| WO | WO02100596 | 12/2002 |
| WO | WO2004030861 | 4/2004 |

OTHER PUBLICATIONS

Edgecraft Corporation web page printout for "Model 120 EdgeSelect® Professional Knife Sharperner," from website www.edgecraft.com (printed Mar. 9, 2005).

* cited by examiner

*Primary Examiner*—Timothy V. Eley
(74) *Attorney, Agent, or Firm*—Hovey Williams LLP

(57) ABSTRACT

A dressing device (10,90) for sharpening or conditioning of a blade (18) or the like includes one or more disk pairs (36–40,108), each having a pair of disks (52,54,110,112) respectively presenting a series of circumferentially spaced, projecting teeth (64) with openings (66) therebetween. The disks (52,54,110,112) are oriented in face-to-face relationship with the teeth (64) thereof in meshed, intercalated relationship to thereby create circumferential dressing openings (76,122). The dressing surfaces (74) of the teeth (64) are of arcuate, concave configuration so as to create a desirable gothic-arch edge on a blade (18) or the like.

20 Claims, 4 Drawing Sheets

KNIFE BLADE DRESSING APPARATUS

BACKGROUND OF THE INVENTION

1. Field of the Invention

The present invention is broadly concerned with blade dressing devices for the sharpening or conditioning of knife blades or other elongate objects or utensils. More particularly, the invention is concerned with dressing devices of the type including a pair of rotatable, toothed, biased-together disks cooperatively defining a circumferential dressing opening, in which a knife or the like is dressed (i.e., sharpened or steeled).

2. Description of the Prior Art

Man has required a means for sharpening knives, blades, and other edged utensils for thousands of years. The simplest sharpening device is an abrasive sharpening stone which is drawn over a blade or the like in an effort to create a sharpened edge. Effective sharpening using such stones requires considerable skill. A wide variety of more sophisticated sharpening devices have also been proposed, such as V-notch sharpeners intended to simultaneously sharpen both edge faces of a blade. Generally, these V-notch sharpeners do not provide any integrated control of blade angle, but depend upon the skill of the user to properly orient the blade for sharpening.

U.S. Pat. No. 2,646,653 describes a knife sharpening apparatus including a pair of opposed, toothed disks which cooperatively define a circumferential knife-receiving opening. Each disk has spaced apart, inclined, projecting teeth which mesh with the teeth of the opposing disk. The disks are also biased together by means of a spring arrangement. Other types of sharpening devices are illustrated in U.S. Pat. Nos. 989,692, 5,390,431, 4,090,418, 4,685,250, 6,290,582, 5,655,959, 4,672,778, 5,390,445, 5,478,272, 4,807,399, and 6,012,971, as well as published Patent Application No. U.S. 2004/0171337.

One particularly desirable edge sharpening technique seeks to form what is referred to as a gothic-arch edge. A gothic-arch edge presents symmetrical, convex blade side surfaces leading to a common knife edge. This type of sharpening is especially difficult to reliably obtain using conventional sharpening equipment of the type described above.

There is accordingly a need in the art for improved dressing or sharpening equipment for knife blades or other similar implements which can be used by consumers or other unskilled people while still obtaining a true gothic-arch edge.

SUMMARY OF THE INVENTION

The present invention overcomes the problems outlined above and provides dressing apparatus for knives or the like. According to one aspect of the present invention, the dressing apparatus for knives or the like includes a pair of rotatable disks each presenting a plurality of circumferentially spaced, outwardly projecting teeth. The teeth have an outermost dressing surface. The disks are oriented in a face-to-face relationship with the teeth thereof in meshed, intercalated relationship to cooperatively define between the dressing surfaces of the teeth a circumferentially extending opening for receipt of a knife or the like to be dressed when the disks are rotated. Moreover, each of the dressing surfaces is of concave configuration.

Another aspect of the present invention concerns a dressing disk for use in a dressing apparatus for knives or the like, wherein the apparatus utilizes a pair of the disks yieldably biased toward one another to cooperatively present a circumferential dressing opening for receiving a knife or the like to be dressed when the disks are rotated. The dressing disk includes a base presenting an outer circumferential margin and a plurality of circumferentially spaced teeth projecting outwardly from the base. Adjacent ones of the teeth are spaced so as to receive a tooth of the other disk of the pair therebetween. Each of the teeth present an outermost dressing surface that extends along and partly defines the dressing opening. Moreover, the dressing surface of each tooth is of concave configuration.

Other aspects and advantages of the present invention will be apparent from the following detailed description of the preferred embodiments and the accompanying drawing figures.

BRIEF DESCRIPTION OF THE DRAWING FIGURES

Preferred embodiments of the invention are described in detail below with reference to the attached drawing figures, wherein.

Figure 4:
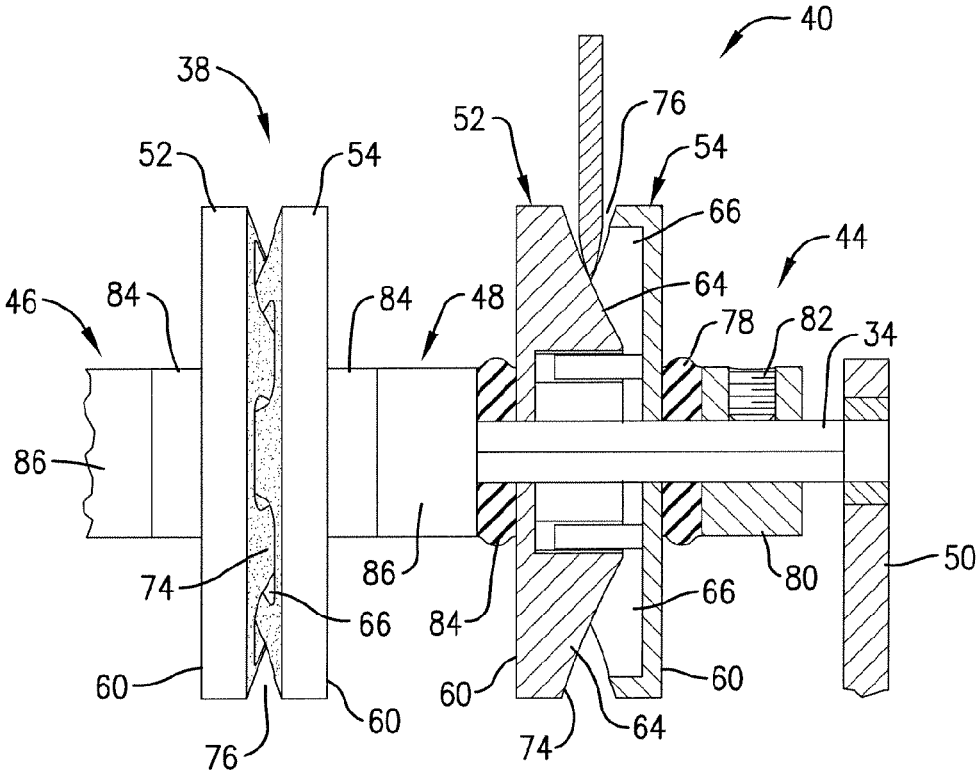
FIG. 4 is a fragmentary view in partial vertical section illustrating in detail the biased-together intercalated relationship of a pair of the rotatable disks forming a part of the sharpener, with a knife blade between a pair of the disks.
Figure 4A:
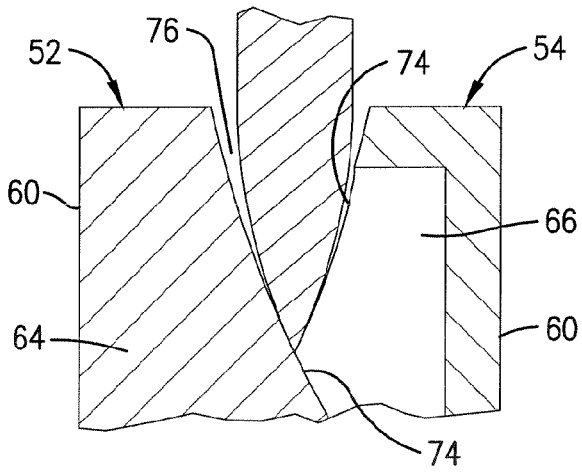
Figure 5:
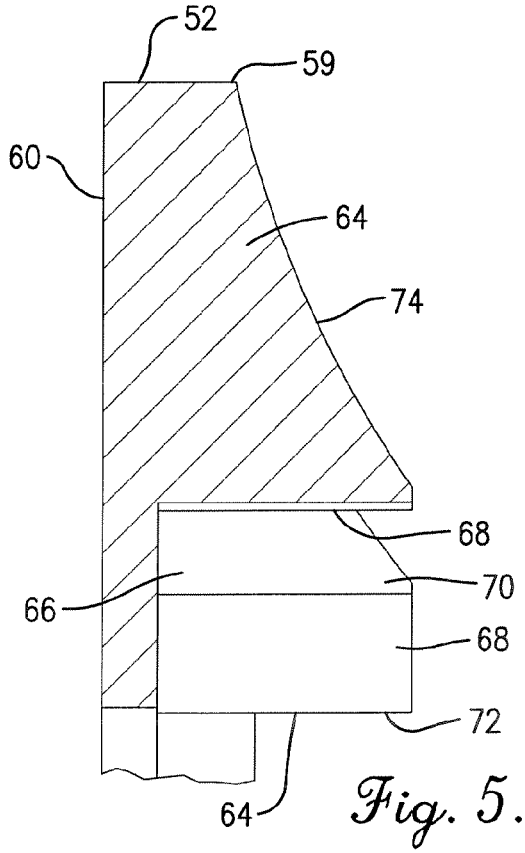
Figure 6:
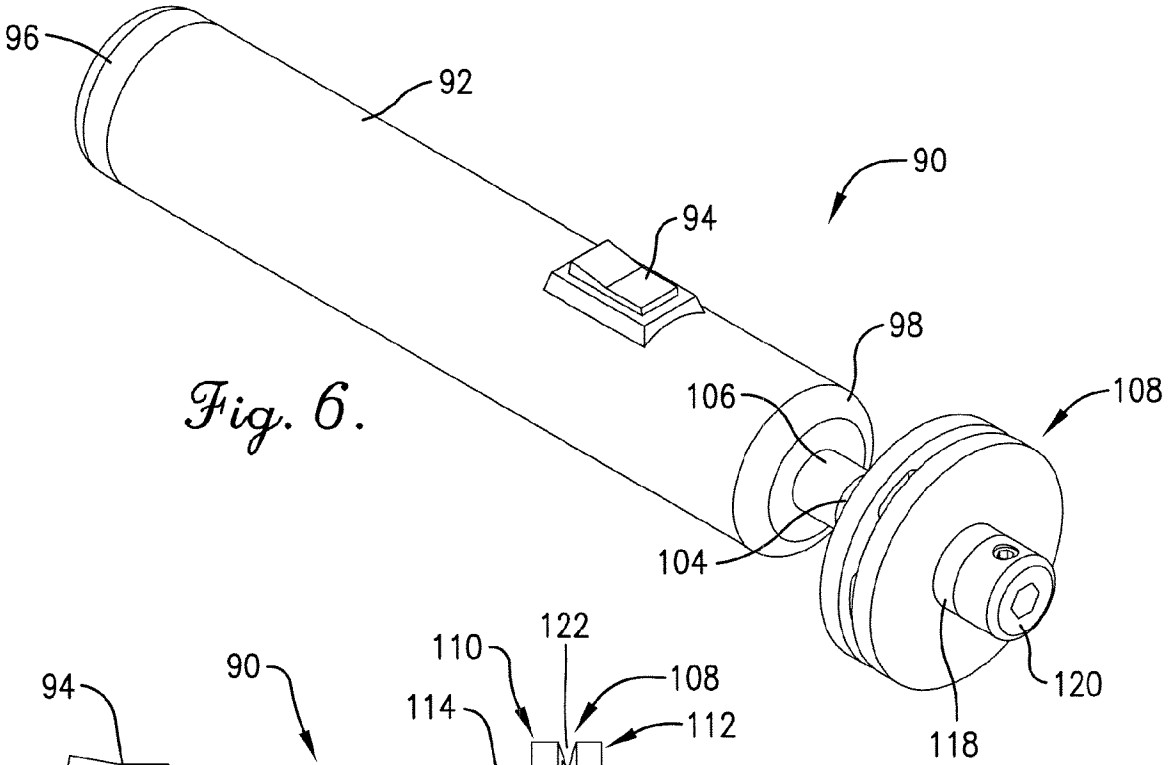
Figure 7:
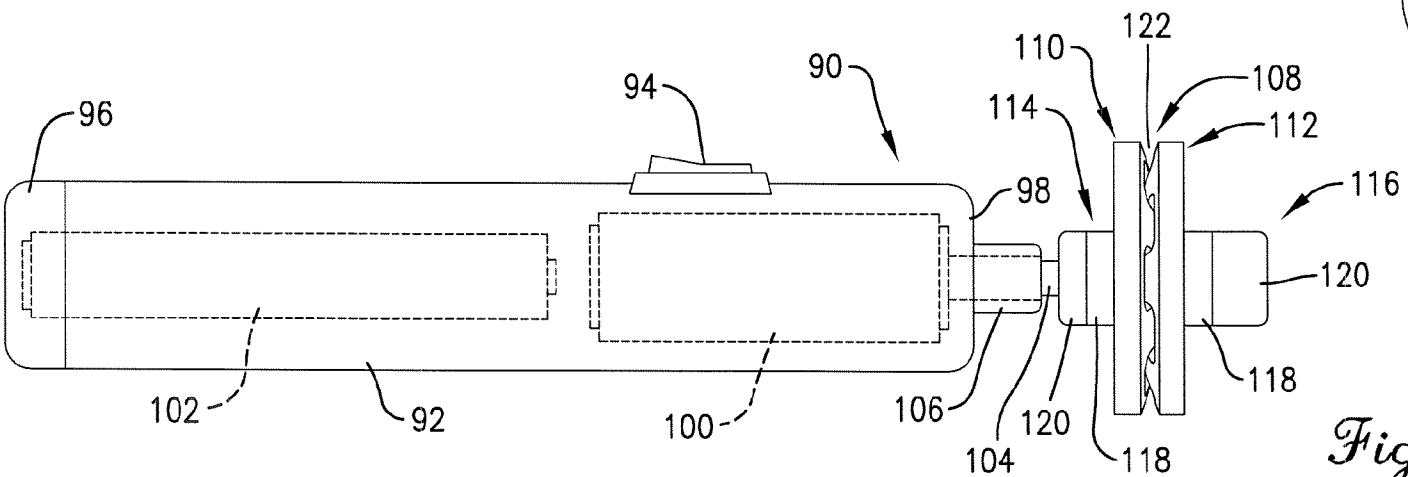

FIG. 4*a* is an enlarged, fragmentary view from FIG. 4 illustrating in detail the orientation of a pair of the disks with a knife blade inserted therebetween;

FIG. 5 is an enlarged, fragmentary view in partial vertical section illustrating the concave configuration of the dressing teeth forming a part of the disks;

FIG. 6 is a perspective view of another embodiment of the invention in the form of a portable, handheld, battery operated dressing device; and FIG. 7 is a side view of the device shown in FIG. 6 and depicting in phantom the internal components of the device housing.

DETAILED DESCRIPTION OF THE PREFERRED EMBODIMENTS

Figure 1:
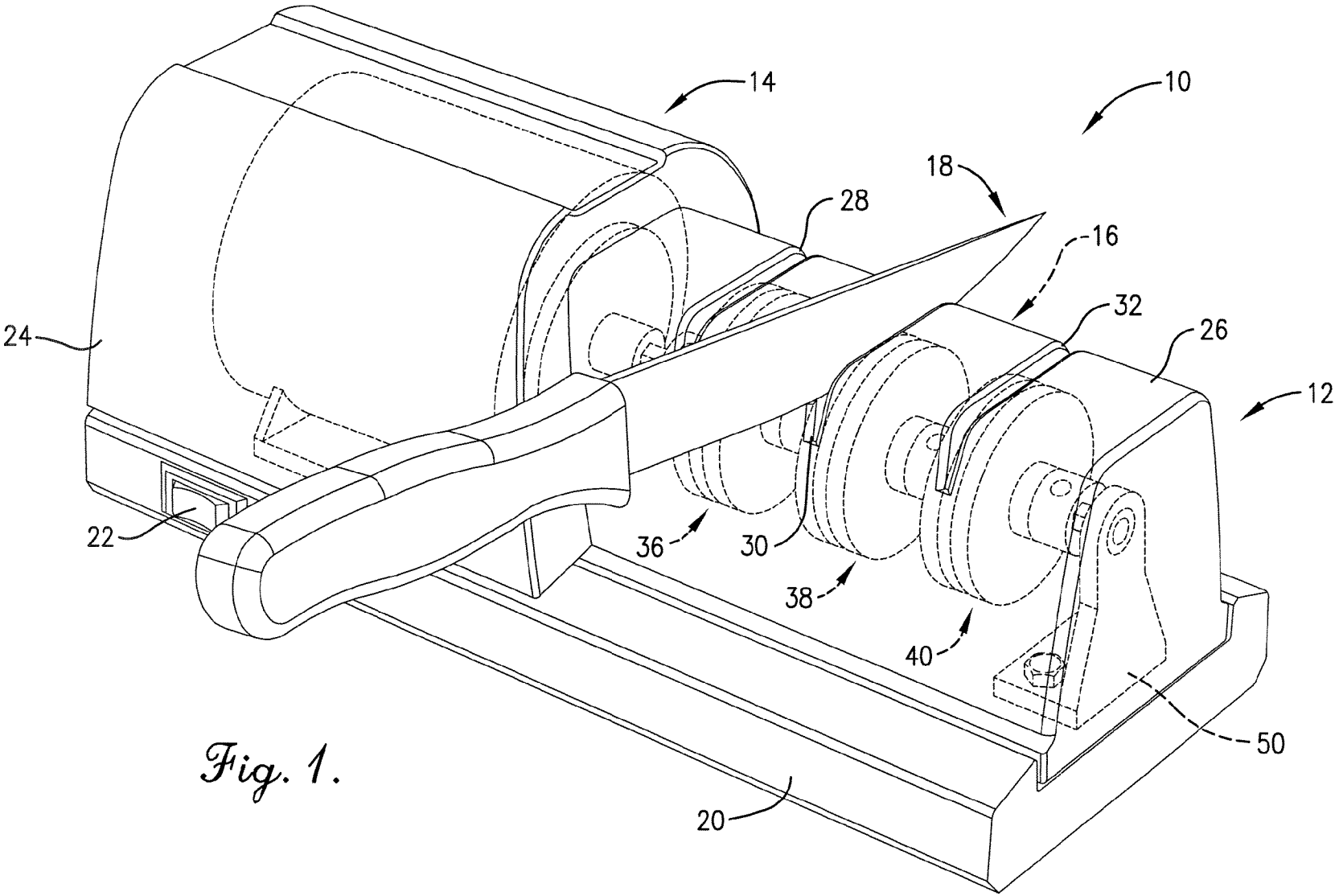
FIG. 1 is a perspective view partially in phantom, of a preferred knife sharpener apparatus in accordance with the invention, shown during sharpening of a knife.

Turning now to the drawings, a knife sharpening apparatus 10 is depicted in FIG. 1 and broadly includes a housing 12 having a conventional, internal electrical drive motor 14 and a sharpening assembly 16 operatively connected with motor 14. The purpose of apparatus 10 is to sharpen a knife blade 18 or other similar object or utensil, and to provide the sharpened blade with a so-called gothic-arch edge deemed most efficient for cutting purposes. As will be described, however, the principles of the present invention are equally applicable to other types of knife blade dressing devices, such as a knife blade steeler.

In more detail, the illustrated housing 12 includes a base 20 sized to support motor 14 and assembly 16. The housing is preferably equipped with a motor off-on switch 22. The housing 12 also has an upstanding, arcuate motor cover 24 supported on base 20, as well as a laterally projecting cover 26 disposed over the assembly 16. The cover 26 has three spaced apart slots 28, 30 and 32 formed therein and located to permit access to the operative components of assembly 16 as will be explained.

The sharpening assembly 16 is best illustrated in FIGS. 2–5 and includes an elongated, hexagonal in cross section drive shaft 34 operatively connected to motor 14 for rotation therewith. The illustrated assembly 16 further includes three separate axially spaced apart dressing disk pairs 36, 38 and 40 mounted on shaft 34. The shaft 34 also supports a pair of end mounts 42,44 respectively adjacent the disk pairs 36,40, and intermediate mounts 46,48 located on opposite sides of disk pair 38. The outer end of shaft 34 remote from motor 14 is rotatably supported by upstanding bearing fixture 50 secured to base 20.

Figure 3:
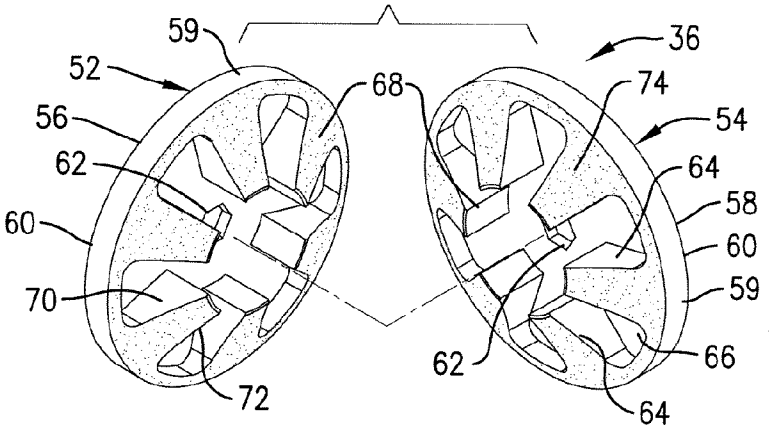
FIG. 3 is an orthogonally exploded view of a pair of rotatable disks forming a part of the FIG. 1 sharpener.
Figure 2:
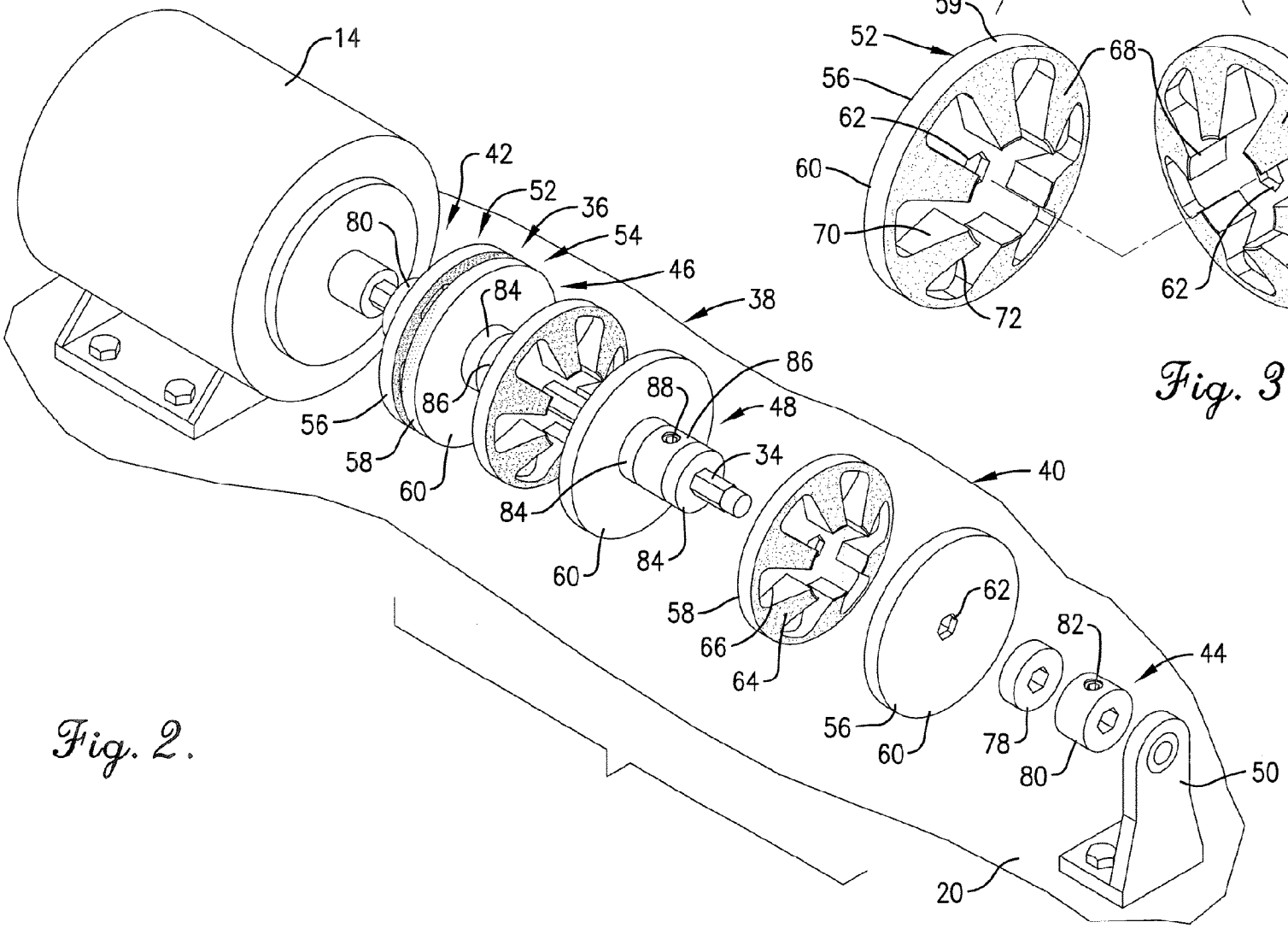
FIG. 2 is a partially exploded perspective view of the operative components of the sharpener depicted in FIG. 1.

Each of the dressing disk pairs 36–40 is structurally identical, except for the nature of the abrasive carried thereby as will be explained. In detail, and referring to FIG. 3 illustrating the disks 52,54 making up pair 36, it will be observed that each disk 52,54 has a circular base 56,58 presenting an outer margin 59, an essentially planar back face 60, and a central, hexagonal drive-shaft-receiving opening 62. The forward face of each disk is defined by a series of circumferentially spaced, radially inwardly and axially outwardly extending dressing teeth 64 with an elongated slot-like opening 66 between each adjacent pair of teeth 64. It will be seen that each of the teeth 64 extends radially inwardly from margin 59 terminating at an inner wall 68, this latter preferably having a width of around one-half inch. The opposed sidewalls 70,72 of each tooth converge so that the tooth is wider at its base adjacent margin 59, as compared with the width at wall 60. Finally, each tooth of the apparatus 10 has an abrasive dressing surface 74 extending between margin 59 and wall 68, and laterally between side walls 70,72. The surfaces 74 are longitudinally arcuate, i.e., the surface is concave throughout the radial length of the tooth, as perhaps best shown in FIG. 5. Preferably, the concave configuration of each dressing surface 74 is defined by a radius of curvature of from about 3.0 to 3.5 inches, with the most preferred radius being about 3.25 inches.

In the embodiment depicted in FIGS. 1–5, the surfaces 74 of each disk pair 36–40 have different abrasive surfaces. The surfaces 74 of pair 36 carry the coarsest abrasive, whereas the surfaces 74 of pairs 38 and 40 are progressively less coarse. More particularly, the disks are preferably formed of a suitable rigid, non-corrosive material, such as stainless steel or Aluminum. Furthermore, the abrasive nature of the surfaces 74 is preferably formed by adhering a grit to the underlying portion of the disk. Suitable grit materials include Silicon Carbide or Aluminum Oxide, with the grit size increasing from disk 36 to disk 40.

Those ordinarily skilled in the art will also appreciate that the apparatus may include more or less disk pairs than shown. For example, the apparatus may alternatively be provided with only one disk pair or two disk pairs of different abrasive qualities. In the single pair arrangement, the surfaces of the teeth may alternatively be smooth (e.g., a smooth stainless steel surface) so as to provide a steeler for the knife blade. A steeler may also be provided in the multiple pair apparatuses, such that sharpening and steeling of a blade can be achieved with a single apparatus.

Returning to the illustrated embodiment, the disks 52,54 making up each of the pairs 36–38 are oriented in face-to-face relationship with the teeth 64 of disk 52 received within the opposing openings 66 of disk 54, and vice-versa. In this manner, the teeth are in a meshed, intercalated relationship and thereby cooperatively define a circumferentially extending, outer blade-receiving opening 76 extending around the entire periphery of the disk pairs.

The disk pair mounts 42–48 are designed to provide proper spacing between the disk pairs 36–40, and also to resiliently bias together the disks 52,54 of each pair. To this end, the end mounts 42,44 include a resilient elastomeric biasing ring 78 supported on shaft 34, as well as a locking ring 80 also on shaft 34. The ring 80 is equipped with a set screw 82. The latter engages a face of shaft 34 to hold the ring 78 in place against disk rear face 60 of the disks 56. The intermediate mounts 46,48 include a pair of resilient rings 84 with a central locking ring 86 likewise having a set screw 88 for affixing the mounts to shaft 34. As best illustrated in FIG. 4, the mounts 42–48 are secured to shaft 34 in a manner to normally bias the disks 52,54 of each disk pair together, thereby insuring that during rotation of the disks the latter remain in their operative, intercalated relationship. The bias also provides proper engagement with the knife blade during rotation of the disks and insertion of the blade into the opening 76. It is also within the ambit of the present invention to utilize helical springs or other suitable component(s) for yieldably biasing the disks of each pair toward one another.

Again referring to FIG. 1, it will be noted that the respective slots 28–32 are oriented to overlie the disk pairs 36–40, and particularly to allow access to the blade-receiving openings 76 presented by each such disk pair.

In the use of apparatus 10, motor 14 is activated by switch 22, thereby causing the disk pairs 36–40 to rotate. The user then places blade 18 first within slot 28 so as to effect coarse sharpening of the blade by the action of the dressing surfaces 74 of disk pair 36. During such sharpening, the user presses the blade 18 downwardly and moves the blade lengthwise (e.g., backwards and forwards) within the opening 76 to assure even sharpening. The downward pressing of the blade 18 serves to slightly separate the disks 52,54 against the bias of the adjacent resilient rings 84,78. See FIGS. 4 and 4*a* where downward force of the blade 18 serves to radially expand the rings 78,84; it will also be appreciated that the concave dressing surfaces 74 have been have been exaggerated in FIG. 4*a* to better illustrate the invention. Consequently, the blade 18 is formed and sharpened in a desirable gothic-arch edge in conformance with the concave configuration of the dressing surfaces 74.

After coarse sharpening is completed, the user then preferably repeats this same sharpening action, using the intermediate disk pair 38 and finally the endmost disk pair 40. Inasmuch as these disk pairs have finer abrasive dressing surfaces 74, the blade 18 is finely sharpened to create the desirable cutting edge on blade 18.

FIGS. 6 and 7 illustrate another embodiment of the invention, in the form of a portable, handheld dressing device 90. The device 90 includes an elongated housing 92 having an on-off switch 94, a removable end cap 96 and an opposed shaft end 98. A motor 100 is located within housing 92, along with a removable battery 102 providing power to the motor 100. A rotatable output shaft 104 extends outwardly through end 98 and is supported by bearing 106. The outer end of shaft 104 supports a disk pair 108 comprising opposed disks 110,112 having the same toothed configuration as the previously described disks 52,54; therefore, a detailed description of these disks 110,112 is unnecessary. The toothed, intercalated disks 110,112 are biased together by means of inner and outer mounts 114,116 identical with the mounts 42,44 previously described. Thus, each of the mounts 114,116 includes an inner resilient ring 118, as well as a set screw-mounted locking ring 120. The intercalated teeth of the disks 110,112 cooperatively define a circumferentially dressing opening 122.

The device 90 may be used for sharpening, in which case the disk teeth would carry an abrasive, as in the manner of the teeth 64. However, the illustrated device 90 is used as a "steeler" such that the blade-engaging surfaces are without abrasive grit, and in such form would be used to condition a blade or the like.

The preferred forms of the invention described above are to be used as illustration only, and should not be utilized in a limiting sense in interpreting the scope of the present invention. Obvious modifications to the exemplary embodiments, as hereinabove set forth, could be readily made by those skilled in the art without departing from the spirit of the present invention.

The inventor hereby states his intent to rely on the Doctrine of Equivalents to determine and assess the reasonably fair scope of the present invention as pertains to any apparatus not materially departing from but outside the literal scope of the invention as set forth in the following claims.

What is claimed is:

1. A dressing apparatus for knives or the like, said apparatus comprising:

a pair of rotatable disks each presenting a plurality of circumferentially spaced, outwardly projecting teeth each having an outermost dressing surface, said disks being oriented in a face-to-face relationship with the teeth thereof in meshed, intercalated relationship to cooperatively define between the dressing surfaces of said teeth a circumferentially extending opening for receipt of a knife or the like to be dressed when the disks are rotated, each of said dressing surfaces being of concave configuration.

2. The apparatus as claimed in claim 1, each of said disks presenting an outer circumferential margin, each of said teeth extending radially inwardly and axially outwardly from the outer margin of the corresponding disk to a tooth end spaced from the outer margin whereby each of the teeth have the greatest depth at the tooth end.

3. The apparatus as claimed in claim 1, each of said disks presenting an outer circumferential margin, each of said teeth tapering inwardly from the outer margin of the corresponding disk whereby the teeth are widest adjacent said margin.

4. The apparatus as claimed in claim 1, said dressing surfaces being coated with an abrasive grit.

5. The apparatus as claimed in claim 1, said disks being resiliently biased together.

6. The apparatus as claimed in claim 1, said dressing surfaces cooperatively configured to provide a gothic-arch edge profile to said knife or the like.

7. The apparatus as claimed in claim 1, each of said dressing surfaces having an arcuate shape with a radius of curvature of from about 3.0 to 3.5 inches.

8. The apparatus as claimed in claim 7, said radius of curvature being about 3.25 inches.

9. The apparatus as claimed in claim 1, each of said disks presenting an outer circumferential margin, each of said teeth presenting an inboard width remote from the outer margin of the corresponding disk, said inboard width being about one-half of an inch.

10. The apparatus as claimed in claim 1; and a rotatable a drive shaft supporting said disks.

11. The apparatus as claimed in claim 10, said drive shaft supporting a plurality of axially spaced apart pairs of said disks.

12. The apparatus as claimed in claim 10; and a battery-operated motor operatively coupled with said shaft for powered rotation thereof.

13. The apparatus as claimed in claim 12; and a housing receiving said motor and a battery therefor.

14. A dressing disk for use in a dressing apparatus for knives or the like, wherein the apparatus utilizes a pair of the disks yieldably biased toward one another to cooperatively present a circumferential dressing opening for receiving a knife or the like to be dressed when the disks are rotated, said dressing disk comprising:

a base presenting an outer circumferential margin; and a plurality of circumferentially spaced teeth projecting outwardly from the base, with adjacent ones of the teeth being spaced so as to receive a tooth of the other disk of the pair therebetween, each of said teeth presenting an outermost dressing surface that extends along and partly defines the dressing opening, said dressing surface of each of the teeth being of concave configuration.

15. The dressing disk as claimed in claim 14, each of said teeth extending radially inwardly and axially outwardly from the outer margin of the corresponding disk to a tooth end spaced from the outer margin whereby each of the teeth have the greatest depth at the tooth end.

16. The dressing disk as claimed in claim 14, each of said disks presenting an outer circumferential margin, each of said teeth tapering inwardly from the outer margin of the corresponding disk whereby the teeth are widest adjacent said margin.

17. The dressing disk as claimed in claim 14, said dressing surfaces being coated with an abrasive grit.

18. The dressing disk as claimed in claim 14, each of said dressing surfaces having an arcuate shape with a radius of curvature of from about 3.0 to 3.5 inches.

19. The dressing disk as claimed in claim 18, said radius of curvature being about 3.25 inches.

20. The dressing disk as claimed in claim 14, each of said teeth presenting an inboard width remote from the outer margin of the corresponding disk, said inboard width being about one-half of an inch.

* * * * *